US006388217B1

(12) United States Patent
Turner et al.

(10) Patent No.: US 6,388,217 B1
(45) Date of Patent: May 14, 2002

(54) ELECTRIC POWER SWITCH WITH STAIN RELIEF FOR ATTACHMENT WIRING

(75) Inventors: David Curtis Turner, Imperial; Craig Joseph Puhalla, Moon Township, both of PA (US)

(73) Assignee: Eaton Corporation, Cleveland, OH (US)

( * ) Notice: Subject to any disclaimer, the term of this patent is extended or adjusted under 35 U.S.C. 154(b) by 64 days.

(21) Appl. No.: 09/654,957

(22) Filed: Sep. 5, 2000

(51) Int. Cl.[7] ..... H01H 9/02
(52) U.S. Cl. ..... 200/293; 335/202
(58) Field of Search ..... 200/293; 335/8–10, 335/132, 202; 439/810–814, 456, 459; 248/49

(56) References Cited

U.S. PATENT DOCUMENTS

| | | | | |
|---|---|---|---|---|
| 4,206,335 A | | 6/1980 | Kummerow | |
| 4,371,856 A | * | 2/1983 | Holce et al. | 335/202 |
| 4,912,439 A | | 3/1990 | Nagy | |
| 5,278,531 A | * | 1/1994 | Link et al. | 335/202 |
| 5,493,265 A | | 2/1996 | Whipple | |
| 5,510,759 A | * | 4/1996 | Gula et al. | 335/18 |
| 5,875,885 A | * | 3/1999 | Changle et al. | 200/293 |
| 5,928,020 A | * | 7/1999 | Bishop, Jr. et al. | 439/188 |
| 5,933,066 A | * | 8/1999 | Chontas et al. | 335/202 |

* cited by examiner

*Primary Examiner*—P. Austin Bradley
*Assistant Examiner*—Lisa N. Klaus
(74) *Attorney, Agent, or Firm*—Martin J. Moran

(57) ABSTRACT

Strain relief for the electrical leads of attachment devices for electric power switches is provided by pairs of diverging through apertures extending through a molded wall of the switch casing from a first face to a second face to form opposed acute angles at the second face. Each lead is routed through a first aperture of a diverging pair from the first face to the second face, then along the second face and back through the second aperture to the first face. Separate pairs of diverging apertures can be provided for each lead, or they may all be routed through a common, laterally widened pair of apertures. Any tension applied to the leads so routed causes the edges created by the opposed acute angles to bite into and restrain the leads. An adhesive can be injected into the apertures to prevent the leads from being pushed back through the apertures.

12 Claims, 4 Drawing Sheets

ELECTRIC POWER SWITCH WITH STAIN RELIEF FOR ATTACHMENT WIRING

BACKGROUND OF THE INVENTION

1. Field of the Invention

This invention relates to electric power switches with an attachment having wiring leading out of the molded casing of the power switch. More particularly, it is directed to such a power switch having diverging through apertures in a wall of the molded casing of the switch through which the wiring of the attachment device is routed to relieve strain on the wiring imposed by an external pulling force applied to the wiring, and to preclude separation of the wiring from the attachment device, or application of an excessive force on the attachment device through the wiring.

2. Background Information

Electric power switches typically have one or more pole mechanisms each with a set of separable contacts opened and closed by the pole mechanism. Some electric power switches, such as circuit breakers, also have overcurrent protection provided by a trip unit or an overcurrent relay which automatically actuates the operating mechanism to open the separable contacts in response to an overcurrent condition. Other electric power switches, such as contacters for instance, may also have overcurrent protection.

For many applications, an electric power switch may be provided with one or more attachment devices which perform a variety of functions. For instance, a remotely operated power switch can have an attachment device in the form of a solenoid which when actuated, opens the power switch. Other attachment devices provide status information about the switch. Thus, an auxiliary switch reports the opened/closed condition of the switch. A bell alarm includes a switch which indicates, when actuated, that the trip unit of a switch provided with overcurrent protection has been actuated. It is now common to provide communications by which information may be exchanged between a switch and one or more other switches in a distribution system, and/or a remote station.

All of these attachment devices have wiring which extends from the molded casing in which they are mounted. The attachment devices can be mounted generally within the switch housing or casing, or in a separate compartment within the cover for the switch casing. They can also be enclosed within a separate housing mounted to the switch housing.

In some instances, the electrical leads on the attachment device are routed to an external terminal block associated with the switch which in turn connects the leads to external wiring. In other instances, the wiring leads directly from the attachment device to the other switch or remote station. In either case, it is undesirable to permit a pulling force applied to the electrical lead to bear directly on the connections of the wiring to the device. In fact, Underwriters Laboratories, which establishes standard for such devices, has established a pull-out test which requires that each auxiliary wire for an electrical switching device must support 20 pounds of weight for one minutes with the lead disconnected from the attachment device.

There is a need therefore, for an improved electric power switch having a simple, effective, and inexpensive arrangement for relieving strain on the electrical leads of attachment devices.

SUMMARY OF THE INVENTION

This need and others is satisfied by an electric power switch having a molded casing, a switch pole mechanism mounted in the molded casing and an attachment device having at least one electrical lead. The molded casing has a molded wall with a first face and a second face. At least first and second diverging through apertures extend through the casing wall from the first face to the second face. The at least one electrical lead is routed from the first face, through the first aperture, along the second face, and through the second through aperture back to the first face. The first and second through apertures diverge at an included angle of divergence of between about 40 and 80 degrees, but preferably at about 50 degrees. Preferably, these first and second through apertures diverge at substantially equal angles to an axis normal to the first face.

Where the attachment device has an additional electrical lead, the molded wall has diverging third and fourth through apertures extending through the casing molded wall section. The additional electrical lead is routed through a third through aperture to the second face, along the second face and back through the fourth aperture to the first face. These third and fourth through apertures are, respectively, parallel to the first and second through apertures.

In accordance with another aspect of the invention where the attachment device has multiple additional leads, the first and second through apertures form a first pair of through apertures which diverge in a first plane. The casing wall is provided with multiple additional pairs of diverging apertures extending from the first to the second face of the casing wall in multiple additional planes parallel to, and laterally spaced from, the first plane. Each multiple additional lead extends from the first face through one through aperture of an associated additional pair of through apertures to the second face, along the second face, and through the other through aperture of the associated additional pair of through apertures back to the second face.

In yet another aspect of the invention, each of the first and second diverging through apertures is widened to accommodate multiple electrical leads of the attachment. Thus, the first and second through apertures diverge in a first plane and extend in a lateral plane substantially perpendicular to this first plane. All of the multiple leads are routed from the first face through the first through aperture to the second face, along the second face and back through the second aperture to the first face.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to an electric power switch in the form of a circuit breaker; however, it will be apparent that the invention has application to other types of electric power switches, including but not limited to, transfer switches, network protectors, motor starters, motor controllers, and protective relays.

Figure 1:
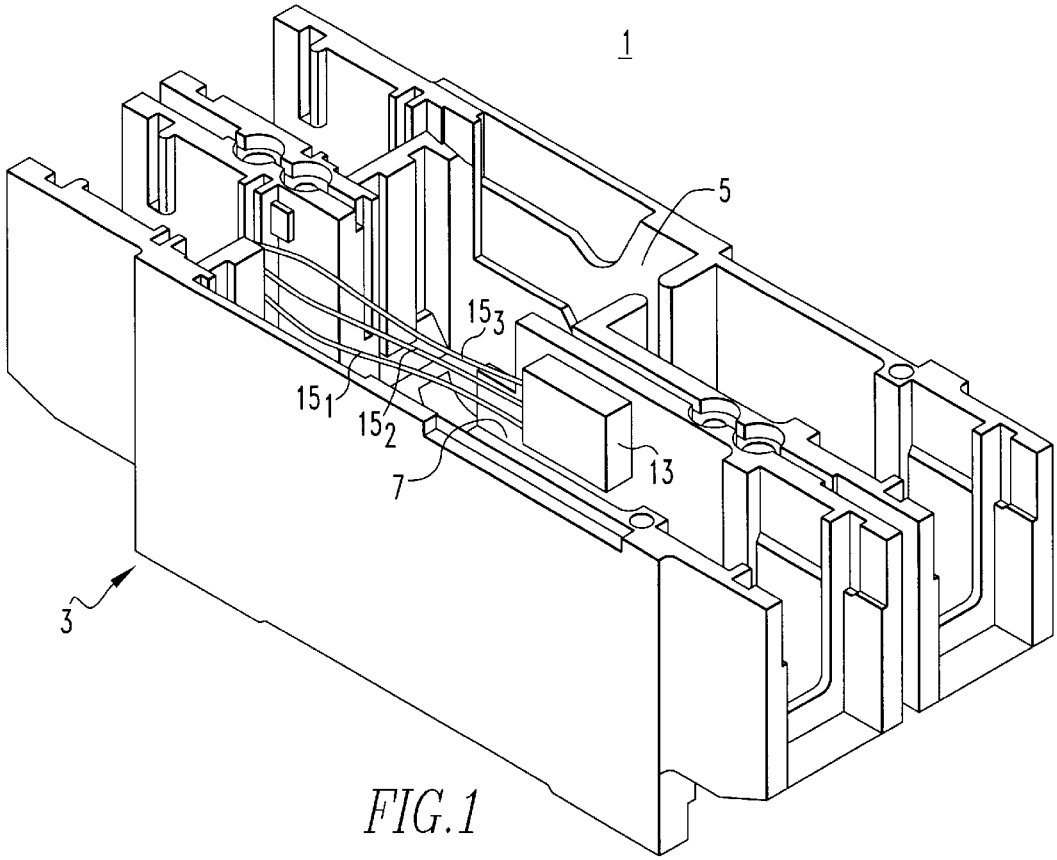
FIG. 1 is an isometric view of an electric power switch in accordance with the invention.
Figure 2:
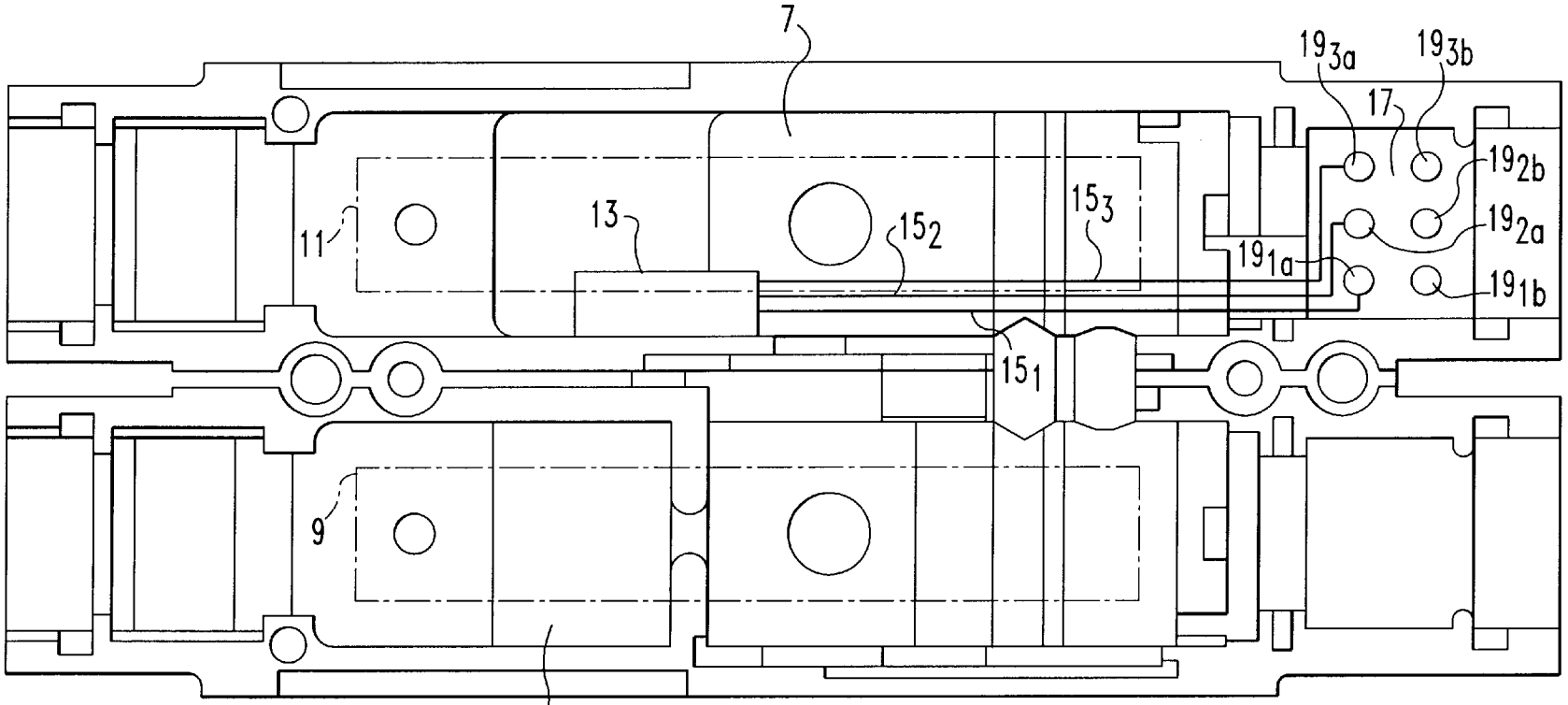
FIG. 2 is a plan view of the electric power switch of FIG. 1.
Figure 3:
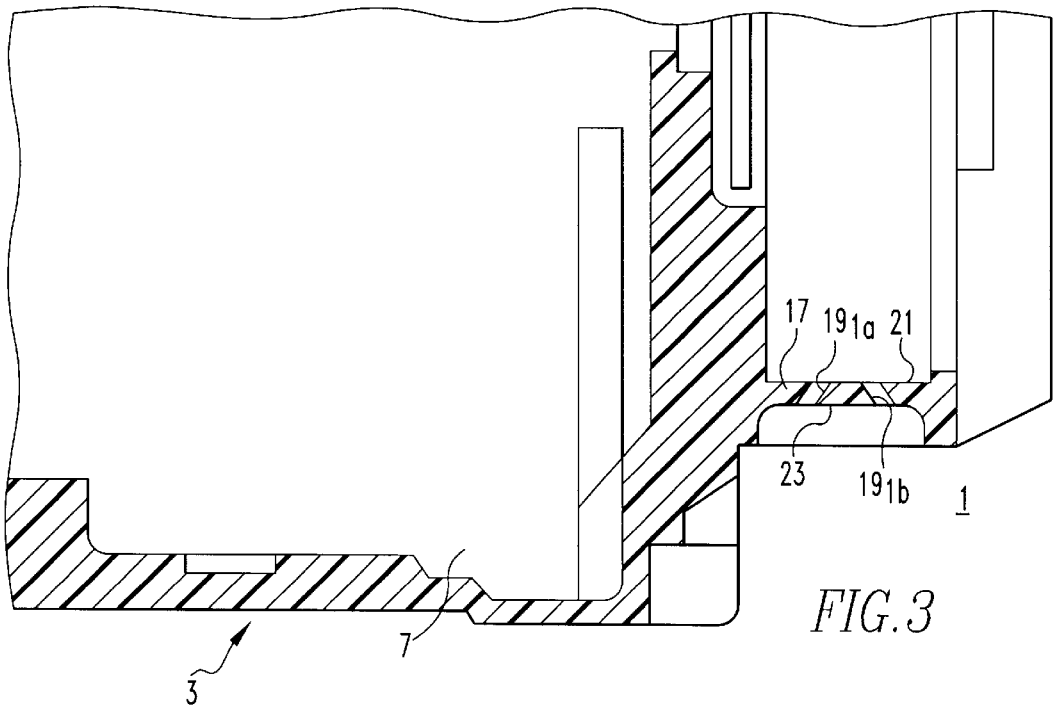
FIG. 3 is a fractional vertical section taken along the lines 3—3 in FIG. 2.

Referring to FIGS. 1–3, the circuit breaker 1 has a molded casing 3 forming side-by-side cavities 5 and 7. The casing 3 is molded of an electrically insulative material such as a polyglass as is well known. A cover (not shown) encloses the cavities 5 and 7.

The particular circuit breaker 1 illustrated is a single pole ground fault circuit breaker. As such, a pole mechanism shown schematically at 9 is mounted in the cavity 5. As is well known, the pole mechanism responds to overcurrent conditions to interrupt current in a protected circuit in which the circuit breaker is connected. A ground fault circuit, shown schematically at 11, is installed in the second cavity 7. This circuit responds to ground faults and is interconnected with the pole mechanism in a manner well known to open the circuit in response to detection of ground fault current.

It is common in circuit breakers such as 1 to have one or more attachment devices such as an auxiliary switch 13. This auxiliary switch 13 provides an electrical signal indicating whether the contacts of the pole mechanism are opened or closed. It is common for such an auxiliary switch to have both a set of normally closed contacts and a set of normally open contacts. Thus, the auxiliary switch 11 has three electrical leads $\mathbf{15}_1$–$\mathbf{15}_2$ which lead out of the circuit breaker 1 to provide an electrical indication of the state of the contacts of the pole mechanism. For instance, the electrical leads $\mathbf{15}_1$–$\mathbf{15}_3$ could be connected to a remotely located control panel. While the exemplary attachment device is an auxiliary switch, other attachment devices performing other functions could also be provided with the circuit breaker. By way of example, the attachment device could be a bell alarm which would provide an electrical indication of whether the pole mechanism had been tripped. Other attachment devices could include a communications module which could be directly wired or through a network connected to other electric power switches and/or a remote station. An example of another attachment device is a trip actuator coil by which the circuit breaker could be remotely tripped.

In any event, the attachment devices have one or more electrical leads 15. As previously mentioned, as these electrical leads extend from the circuit breaker, there is a requirement that a force that might be applied externally to such leads not be transmitted to the attachment device. To this end, the molded casing 3 has a molded wall 17, which in this case is adjacent the cavity 7 in which the auxiliary switch 13 is mounted. This molded wall 17 has three pairs $\mathbf{19}_1$–$\mathbf{19}_3$ of diverging through apertures $\mathbf{19}_1a$–$\mathbf{19}_3b$ extending through the wall 17 from a first face 21 to a second face 23. For instance, a first pair of through apertures $\mathbf{19}_1$ includes a first through aperture $\mathbf{19}_1a$ and a second through aperture $\mathbf{19}_1b$. These pairs of through apertures diverge at an included angle $\alpha$ of between about 40 and 80 degrees with a being about 50 degrees in the exemplary embodiment. Preferably, the apertures $\mathbf{19}_1a$ and $\mathbf{19}_1b$ form equal angles $\alpha_a$ and $\alpha_b$ with an axis 25 perpendicular to the first face 21 of the molded wall 17. The diverging apertures $\mathbf{19}_1a$ and $\mathbf{19}_1b$ form opposed acute angles $\beta_a$ and $\beta_b$ with the second face 23 of the molded wall 17. In the preferred embodiment, these acute angles $\beta_a$ and $\beta_b$ are equal and are each about 65 degrees but can range from about 70 to 50 degrees.

Figure 4:
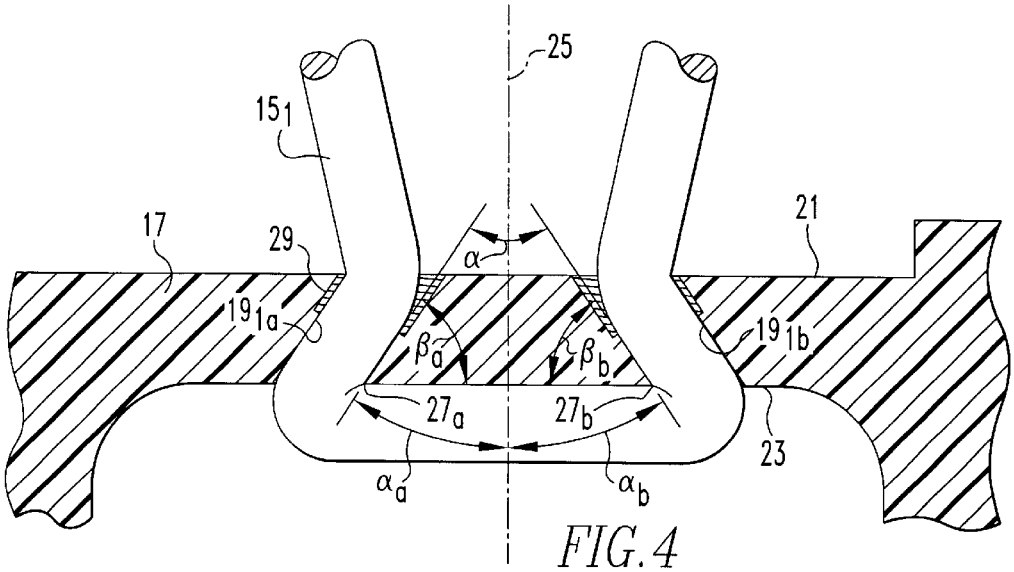
FIG. 4 is a fragmentary section through a portion of the casing which forms part of the switch of FIGS. 1–3.

As shown in FIG. 4, the lead $\mathbf{15}_1$ of the attachment device is routed from the first face 21 of the molded wall 17 through the aperture $\mathbf{19}_1a$ to the second surface 23, along the second surface 23 and back through the aperture $\mathbf{19}_1b$ to the first surface 21. Thus, if a tension force is applied to either end of the lead $\mathbf{15}_1$, the edges $\mathbf{27}_a$ and $\mathbf{27}_b$ formed by the acute angles $\beta_a$ and $\beta_b$ bite into the lead and resist transmission of the tension force to the other ends of the lead $\mathbf{15}_1$. In addition, an adhesive 29, such as for instance SIKA-FLEX, is injected into the apertures $\mathbf{19}_1a$ and $\mathbf{19}_1b$ to secure the lead $\mathbf{15}_1$ in place and prevent pushing of the lead back into the casing.

Figure 5:
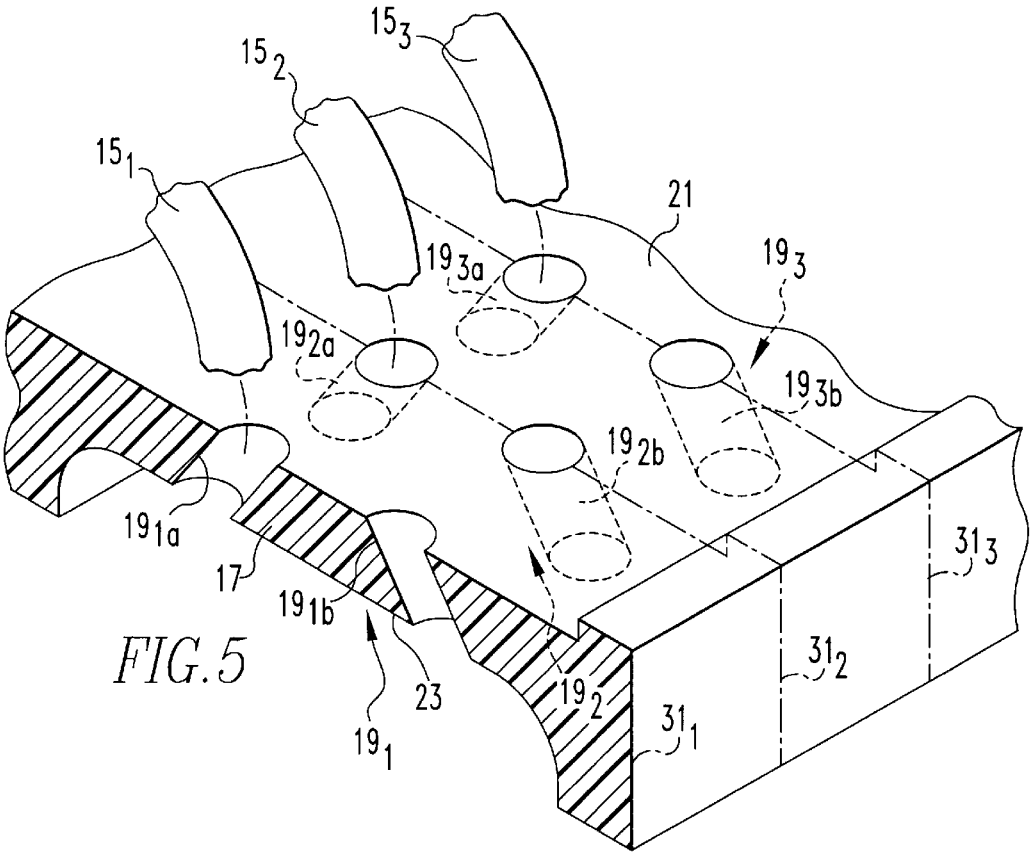
FIG. 5 is a fragmentary metric view of a section of wall of the electric power switch showing a second embodiment of the invention.

As illustrated in FIG. 5, a pair $\mathbf{19}_1$–$\mathbf{19}_3$ of diverging through apertures is provided for each of the leads $\mathbf{15}_1$–$\mathbf{15}_3$. Preferably, the first pair of through apertures $\mathbf{19}_1$ diverge in a first plane $\mathbf{31}_1$. Preferably, the additional pairs of through apertures $\mathbf{19}_2$ and $\mathbf{19}_3$ diverge in additional planes $\mathbf{31}_2$ and $\mathbf{31}_3$ which are parallel to the first plane $\mathbf{31}_1$. Furthermore, it is preferable that the corresponding through apertures of each pair be laterally aligned in the respective planes as shown in FIG. 5, although this is not essential. The leads $\mathbf{15}_1$–$\mathbf{15}_3$ are routed through the respective first aperture $\mathbf{19}_1a$, $\mathbf{19}_2a$, and $\mathbf{19}_3a$ from the first surface 21 to the second surface 23 of the molded wall 17 and then back through the other aperture of the pair.

Figure 6:
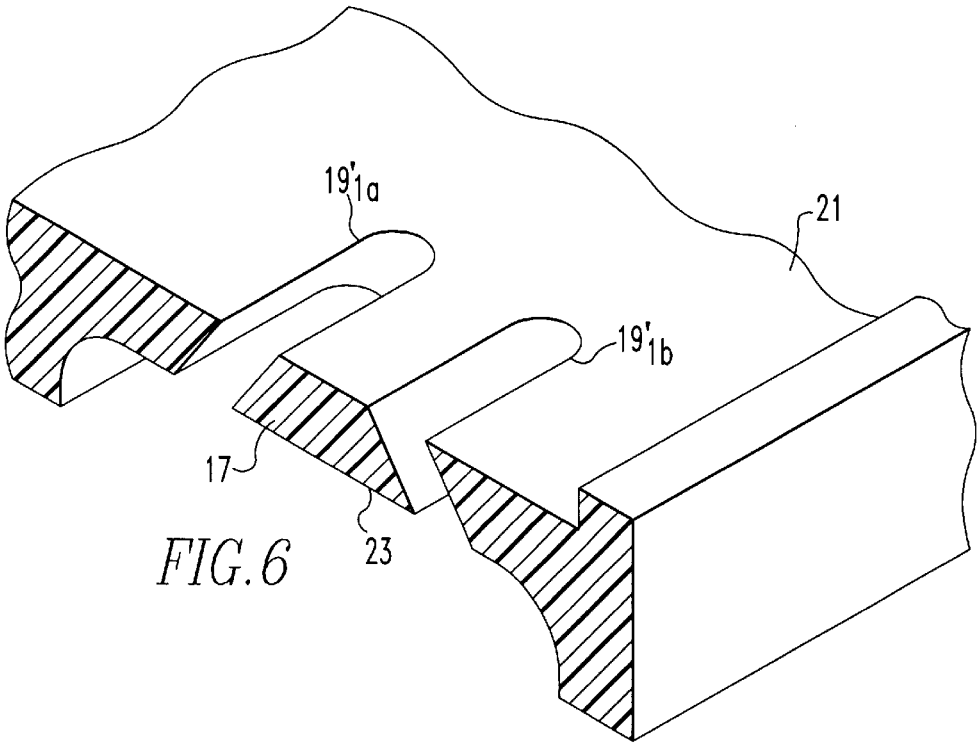
FIG. 6 is a fractional isometric view of a wall section of the electric power switch showing another embodiment of the invention.

As illustrated in FIG. 6, instead of having separate pairs of apertures for each lead, the first aperture $\mathbf{19}_1a'$ and the second aperture $\mathbf{19}_1b'$ can be laterally extended to accommodate multiple leads, such as all three leads in the case of the auxiliary switch 13.

In the exemplary circuit breaker 1, the molded wall 17 is integrally formed as part of the main casing 3. It should be appreciated that in some circuit breakers the attachment device is mounted in a cavity in a cover enclosed by a secondary cover. In that arrangement, the diverging through apertures could be provided either in the primary cover or in the secondary cover depending upon the desired routing of the leads. In addition, the attachment devices in some electric power switches are enclosed in a separate housing mounted to the primary housing. In that case, the diverging through apertures could be provided in a molded wall of that separate housing.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electric power switch comprising:

a molded casing;

a switch pole mechanism mounted in the molded casing; and an attachment device having at least one electrical lead, the molded casing having a molded wall with a first face and a second face, and at least first and second diverging through apertures extending through the molded wall from the first face to the second face to form opposed acute angles with the second face, the at least one electrical lead being routed from the first face through the first aperture along the second face, and through the second through aperture back to the first face.

2. The electrical power switch of claim 1 wherein the diverging through apertures subtend an included angle of divergence of about 40 to 80 degrees.

3. The electric power switch of claim 2 wherein the included angle of divergence is about 50 degrees.

4. The electric power switch of claim 1 wherein the diverging through apertures diverge at substantially equal angles to an axis normal to said first face.

5. The electric power switch of claim 4 wherein the diverging through apertures subtend an included angle of divergence of about 40 to 80 degrees.

6. The electric power switch of claim 5 wherein the angle of divergence is about 50 degrees.

7. The electric power switch of claim 1 wherein the attachment device has an additional electrical lead and the molded wall has third and fourth through apertures extending through the casing wall from the first face to the second face, the additional lead being routed from the first face through the third aperture to the second face, along the second face, and through the fourth aperture back to the first face.

8. The electric power switch of claim 7 wherein the third and fourth through apertures respectively are parallel to the first and second through apertures.

9. The electric power switch of claim 1 wherein the attachment device has multiple additional electrical leads, the first and second through apertures forming a first pair of diverging through apertures, the molded wall having multiple additional pairs of diverging through apertures extending from the first face to the second face, each multiple additional electrical lead extending from the first face through one aperture of an associated additional pair of apertures to the second face, along the second face and through the other aperture of the associated additional pair of apertures back to the first face.

10. The electric power switch of claim 9 wherein the first pair of diverging through apertures diverge in a first plane, and the multiple additional pairs of diverging through apertures diverge in multiple additional planes parallel to and laterally displaced from the first plane.

11. The electric power switch of claim 9 wherein the multiple additional pairs of diverging through apertures are all laterally aligned in the multiple additional planes with the first pair of apertures in the first plane.

12. The electric power switch of claim 1 wherein the at least one electrical lead comprises multiple electrical leads, the first and second through apertures diverge in a first plane and extend substantially perpendicular to the first plane, all of the multiple leads being routed from the first face through the first aperture to the second face, along the second face, and through the second aperture back to the first face.

* * * * *